US005839163A

United States Patent [19]

Hellmann

[11] Patent Number: 5,839,163

[45] Date of Patent: Nov. 24, 1998

[54] GRIP-SHELL ARRANGEMENT

[75] Inventor: Reiner Hellmann, Holz, Germany

[73] Assignee: Vereinigte Stahlwarenfabrik Gebr. Richartz & Söhne GmbH, Solingen, Germany

[21] Appl. No.: 802,725

[22] Filed: Feb. 20, 1997

[30] Foreign Application Priority Data

Feb. 21, 1996 [DE] Germany ..... 296 03 009.0
May 8, 1996 [DE] Germany ..... 296 08 322.4

[51] Int. Cl.[6] ..... A47B 95/02

[52] U.S. Cl. ..... 16/111 R; 16/DIG. 18; 30/526

[58] Field of Search ..... 16/111 R, 110 R, 16/110 A, DIG. 12, DIG. 18, DIG. 24, DIG. 25; 30/526, 340–344; 81/900, 489, 427.5, 177.1; 56/DIG. 18; 74/551.9

[56] References Cited

U.S. PATENT DOCUMENTS 4,172,304 10/1979 Sanelli ..... 16/DIG. 19
4,953,862 9/1990 Uke et al. ..... 81/177.1
5,027,511 7/1991 Miller ..... 30/526
5,261,665 11/1993 Downey ..... 74/551.9
5,290,063 3/1994 Lenhart ..... 16/DIG. 12
5,305,660 4/1994 Hasegawa ..... 74/553
5,327,612 7/1994 Kelsay ..... 16/111 R
5,403,534 4/1995 Kim ..... 30/526

*Primary Examiner*—Chuck Mah
*Attorney, Agent, or Firm*—Martin A. Farber

[57] ABSTRACT

A grip-shell arrangement on a utensil, for instance a pocket knife, a flashlight or the like, the housing wall of which is covered by at least one shell, each shell having a plurality of openings through which there extend plastic knobs of a plastic core which is arranged in the hollow space of the shells and constitutes the connecting member between the shell and housing wall. The plastic core has two regions (3, 4) of different hardness, the knobs (5) being associated with the soft region and the attachment to the housing (1) being associated with the hard region (4).

13 Claims, 6 Drawing Sheets

5
2
9
9
16
11

5
9
16
4
9

IX
7
8
18
5
16
12
8
IX
X
12
XI
XI
15
8
7
IX 2
9
7
4
3
12
5
15
4

GRIP-SHELL ARRANGEMENT

FIELD AND BACKGROUND OF THE INVENTION

The present invention relates to a grip-shell arrangement on a utensil, for instance a pocket knife, a flashlight, or the like.

Such grip-shell arrangements are known, for instance, on pocket knives. The known pocket knife has a flat or wide inner housing with two housing walls which are substantially parallel to each other and between which pins or the like extend around which tools such as knives, files, scissors, or the like can be swung out of the housing. The two housing walls, which extend parallel to each other, are covered on the outside by shells. Each of the shells is backed by a plastic core. The shells, which consist of metal, are fastened to the housing by the plastic cores. In the prior art, the plastic core is glued to the housing and to the shell. The plastic core has outwardly directed knobs which extend through corresponding openings in the shell so as to impart a pleasing appearance to the pocket knife and improve the grip on it.

SUMMARY OF THE INVNETION

The object of the invention is improve the manufacture of a grip-shell arrangement of this type.

According to the invention the plastic core has two regions (3, 4) of different hardness, the knobs (5) being associated with the soft region and the attachment to the housing (1) being associated with the hard region (4).

As a result of the development in accordance with the invention a grip-shell arrangement is obtained in which the plastic core which backs the shell can be applied in a simple and stable manner to the wall of the housing.

The attachment is effected in accordance with the invention by a snap-fastener attachment. In this way, the fixing in place after centering which is, for instance, otherwise necessary upon the attachment is done away with. Development of the core as a plastic core of two materials of different hardnesses has the advantage that a snap fastening which is associated with the region of the hard core is permanent and at the same time the knobs which emerge from the openings in the shell can be formed of a soft material which is favorable for gripping. For the attachment of the two plastic regions of different hardness of the plastic core, it is preferable for the hard plastic part or the soft plastic part to have undercuts behind which material of the other plastic part engages so that a form-locked attachment of the two plastic parts is obtained and the core can lie in form-filling manner within the shell. The soft plastic part is in this connection bonds to the inner wall of the shell. A preferred embodiment of the invention provides that a plane of the hard plastic part rests on the plane of the housing wall and is connected there to it at different places via a snap fastening. The hard plastic core is preferably covered over the entire surface facing away from the housing wall with soft material so that the soft plastic region lies resting at the edge against the housing wall. Here also an edge-side undercutting of the hard plastic core edge is provided, so that the soft plastic core can enter into form-locked back-engagement there. For improved adherence of the two plastic parts, which can also be produced separately, the inner core may have a central, possibly interrupted, slot provided with undercuts. This slot can be open on the housing side so that soft material also rests centrally against the surface of the housing. It is preferably provided that the snap-fastener studs are formed by pins which emerge from the wide side of the housing wall. The snap-fastener studs have radially protruding circumferential projections. These circumferential projections can be formed of profiled sleeves which are pressed out on the pins.

In a preferred embodiment of the invention, the pins which form the snap-fastener studs are the extension of a pivot pin of the tools. The pocket knife is preferably provided on both sides with a shell supported by such an inner core. The pivot pins of the tools can for this purpose protrude on both sides beyond the housing wall and be developed as snap-fastener studs. The plastic core is preferably produced by injection molding. The inner core of hard material is first of all injection molded in a first mold. This inner core is then introduced into a second mold and soft plastic extruded around it. As a result of the undercuts formed, the soft plastic then enters into form-locked attachment to the hard plastic inner-core part. The grip-shell arrangement in accordance with the invention is preferably intended for a pocket knife. Furthermore, such a grip-shell arrangement can also be arranged on an inner housing of a flashlight.

BRIEF DESCRIPTION OF THE DRAWINGS with the above and other objects and advantages in view, the present invention will become more clearly understood in connection with the detailed description of preferred embodiments, when considered with the accompanying drawings, of which:

DETAILED DESCRIPTION OF THE PREFERRED EMBODIMENTS

Figure 1:
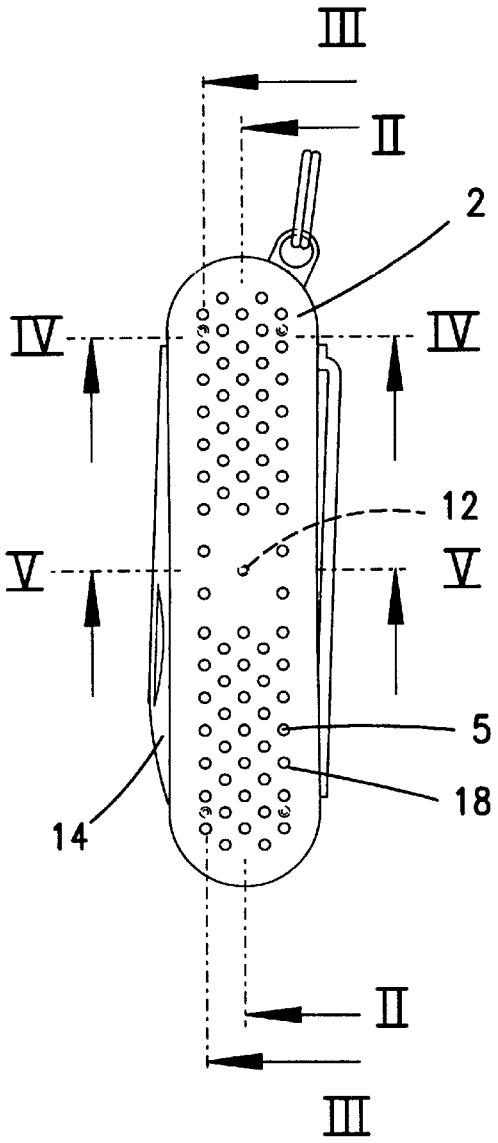
FIG. 1 shows a pocket knife having a grip shell in accordance with the invention.
Figure 2:
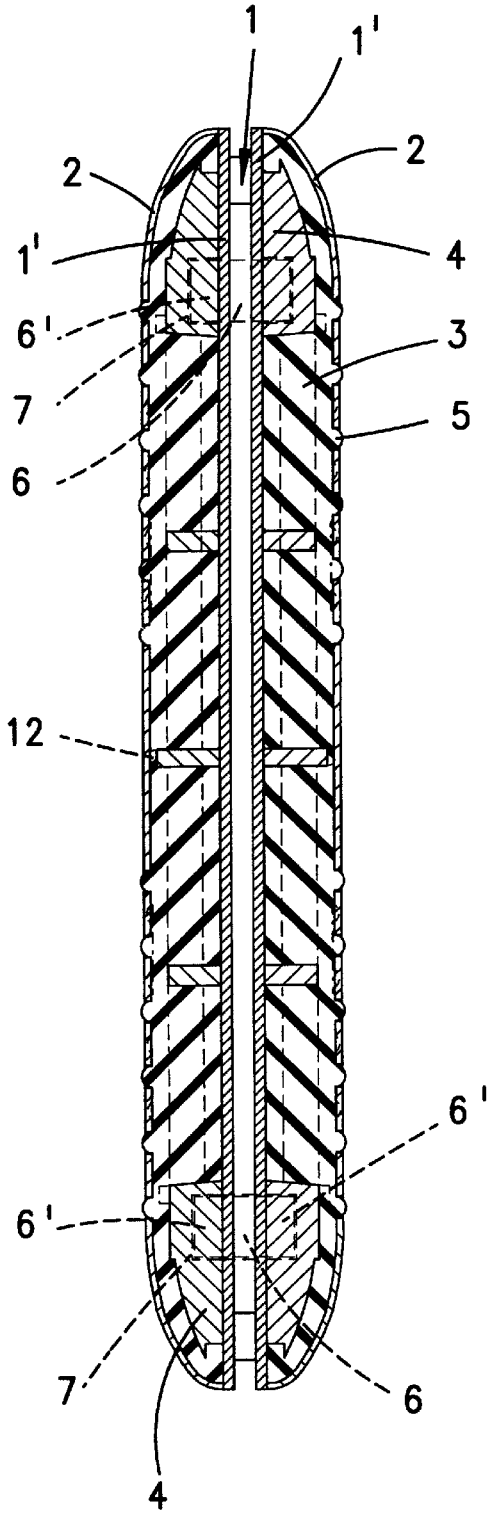
FIG. 2 is an enlarged section along the line II—II of FIG. 1.
Figure 3:
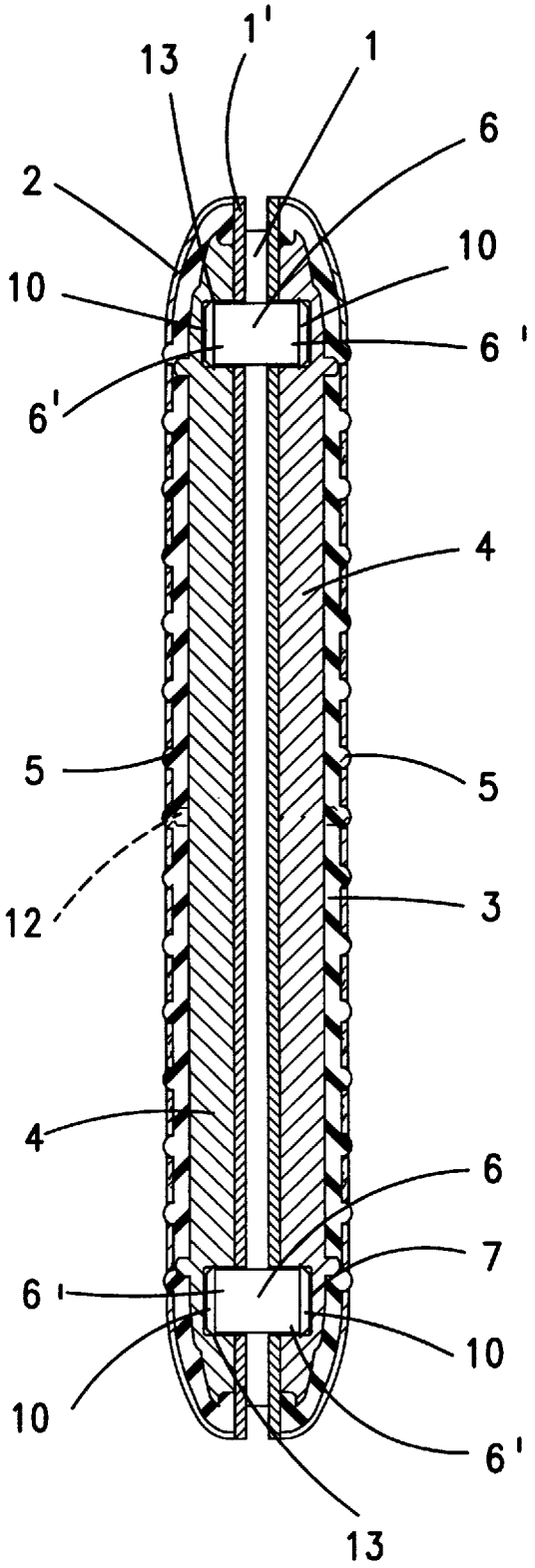
FIG. 3 is a section along the line III—III of FIG. 1.
Figure 5:
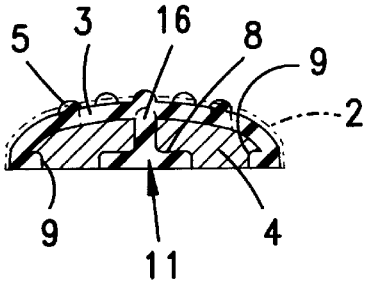
FIG. 5 is a section along the line V—V of FIG. 1.
Figure 4:
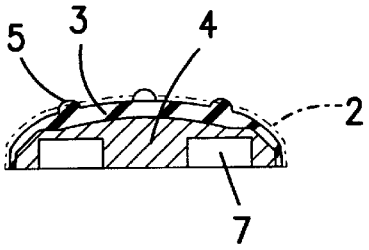
FIG. 4 is a section along the line IV—IV of FIG. 1.
Figure 6:
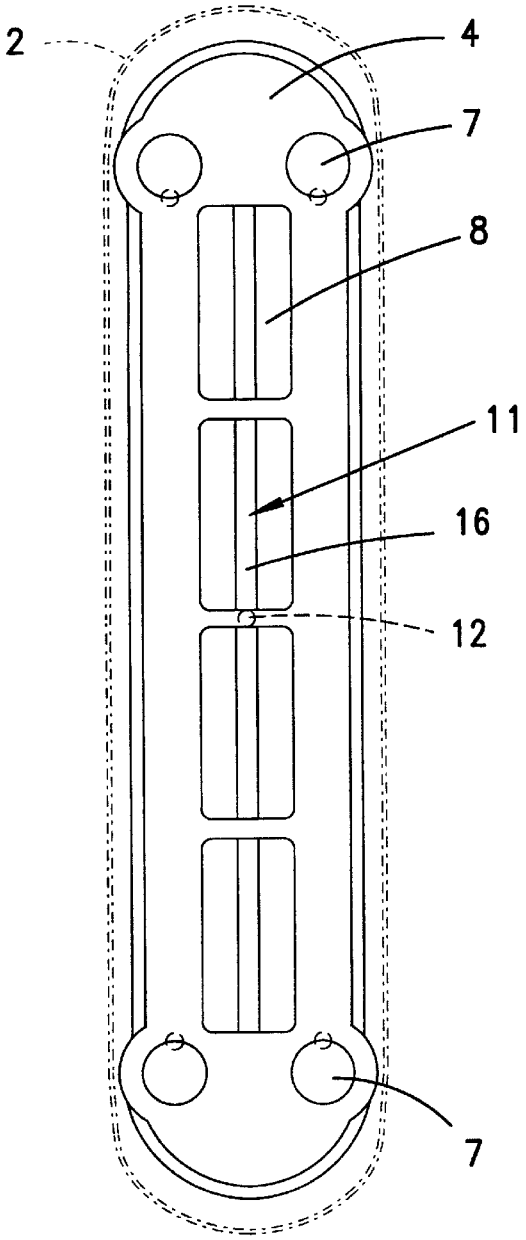
FIG. 6 is a view from below of the hard core part.
Figure 7:
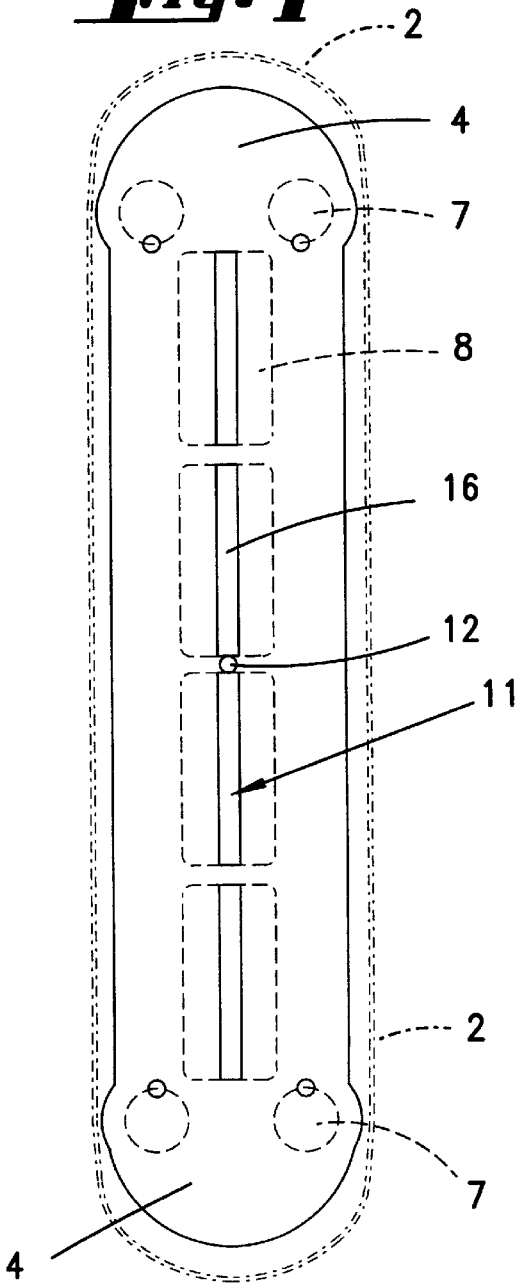
FIG. 7 is a view from above of the hard core part.
Figure 10:
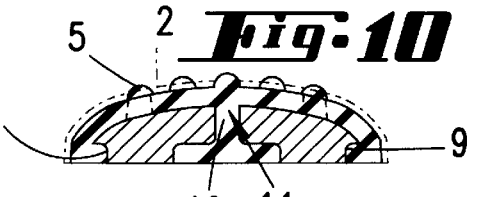
FIG. 10 is a section along the line X—X of FIG. 8.
Figure 11:
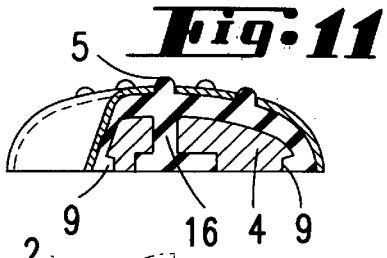
FIG. 11 is a section along the line XI—XI of FIG. 8.
Figure 8:
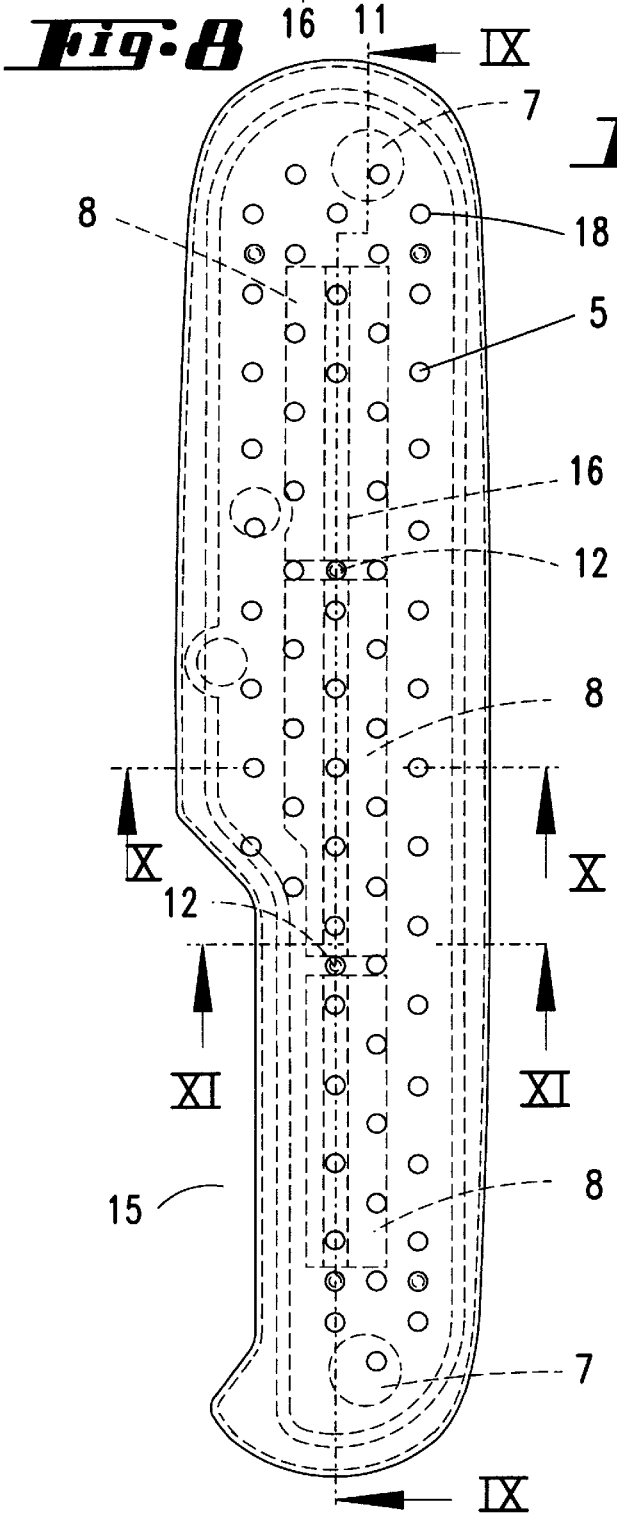
FIG. 8 shows a second embodiment of a grip-shell arrangement in accordance with the invention, seen in top view.
Figure 9:
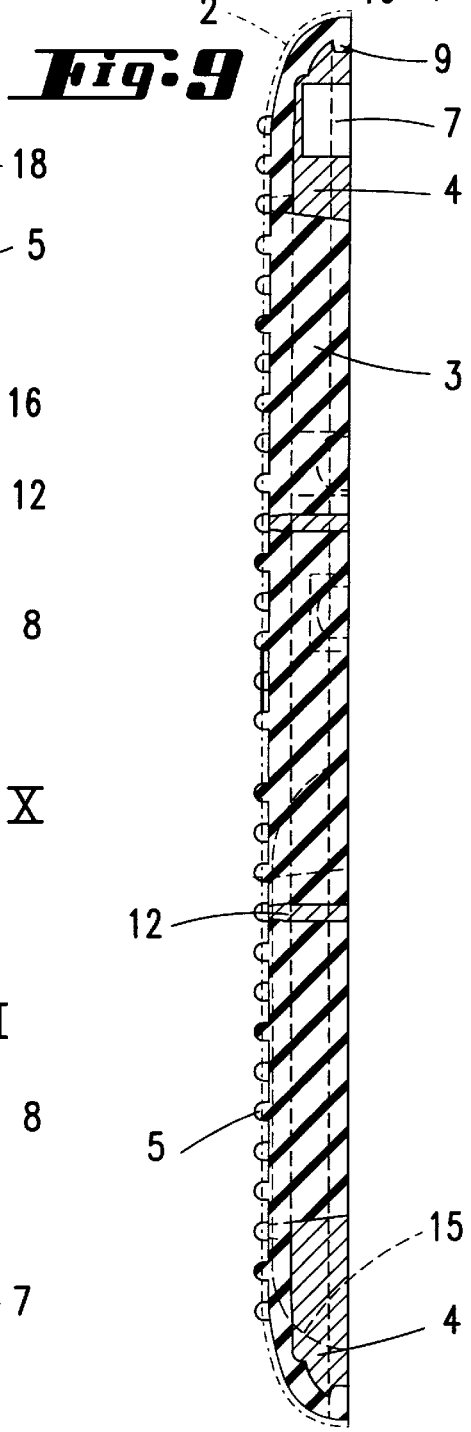
FIG. 9 is a section along the line IX—IX of FIG. 8.
Figure 12:
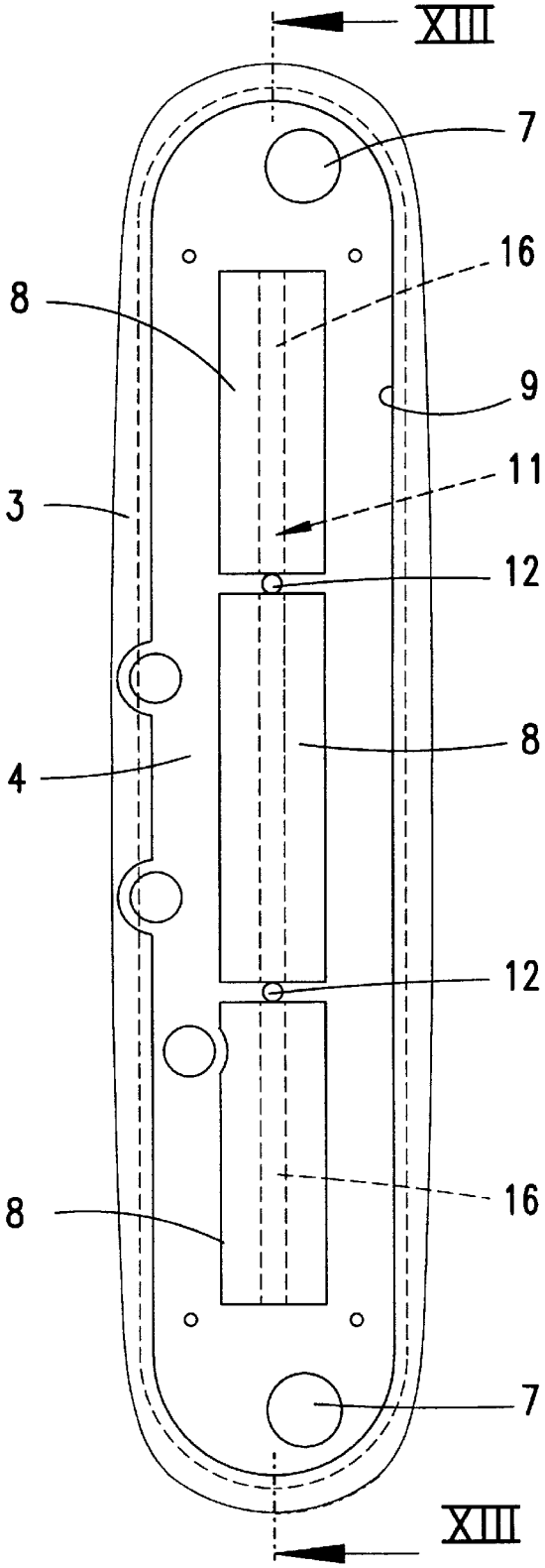
FIG. 12 shows another embodiment in bottom view.
Figure 13:
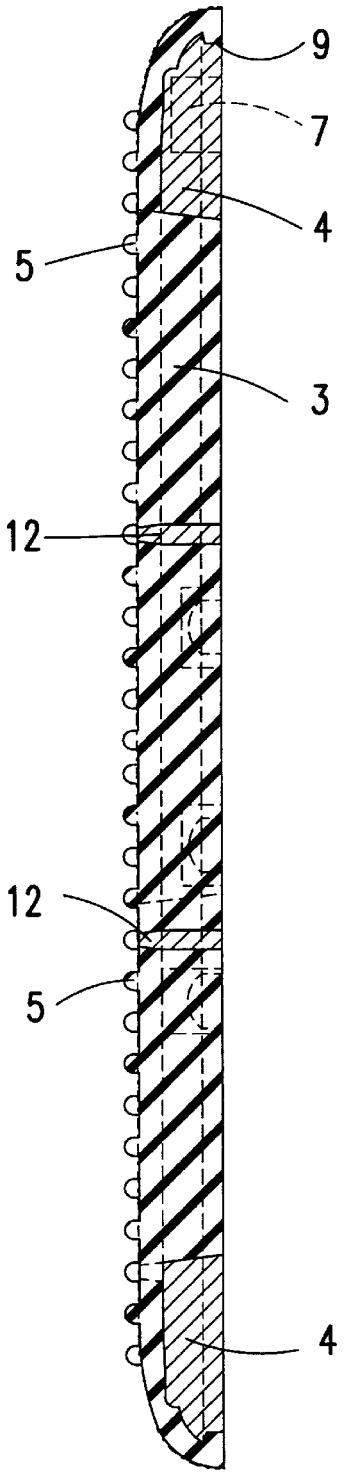
FIG. 13 is a section along the line XIII—XIII of FIG. 12.

The embodiments shown in FIGS. 1 to 13 concern a pocket knife having a knife housing 1 which has two housing walls 1' which are parallel to each other and on which the shell arrangement of the invention is applied. Tools, for instance a knife 14, are arranged swingable around pins 6 within the housing. The end sections 6' of the pins 6 extend beyond the housing walls 1'.

The end section 6' of the pins 6 form snap-fastener studs 10 which are fastened by clipping to the core part 4 of the plastic shell backing. In order to develop a snap fastener stud 10, the end section 6' of the pin 6 has an annular collar 13 which forms a circumferential projection in the region of the free end of the pin. The diameter of the circumferential projection 13 is slightly greater than the diameter of the corresponding opening in the form of a blind hole 7 in the core part.

The shell arrangement has a metal shell 2 which extents over the entire outer surface of the housing wall 1' and forms a hollow space on the inside. The hollow space is filled by a plastic core part 3, 4. The core has a semi-oval shape in cross section. The flat base surface of the core forms the surface of contact with the flat housing wall 1'.

The shell 2 has a plurality of circular openings 18 through which knobs 5 of the core part extend. The knobs extend beyond the outer surface of the shell 2.

The core part which fills the hollow space of the shell 2 consists of regions of plastic of different hardness. An inner core part 4 consists of a hard plastic. The hard core part 4 forms the blind openings 7 by which the core part 4 is clipped onto the snap-fastener studs of the housing. The rounded surface of the core part is bonded to the inner side of the shell 2 and is formed by the core part 3 of soft material. In the same way, the knobs 5 of the core part 3 are formed of soft material. The core part 4 of harder material has openings into which the soft plastic extends. The interruptions form undercuts, so that the soft plastic can be gripped by the hard material.

As shown in the figures, an opening in the hard core part 4 consists of a slot 11 which is interrupted by bars 12. On the shell side, the width of the slot 11 tapers down to a narrow slot 16.

On the edge side, the hard core part 4 has an outward extending projection in the form of a surrounding collar which is gripped from below by the soft plastic 3.

For the production of a grip shell in accordance with the embodiments, the hard plastic core part 4 is first of all produced by injection molding. Thereupon the hard core part 4 is placed in another injection mold and softer plastic is injected around it. The softer plastic need not be bonded to the hard plastic part in view of the fact that it clamps around the hard plastic part 4. The attachment between the soft core part 3 and the hard core part 4 is effected by a form-locked development since the surrounding projection 9 of the slot 11 forms undercuts. The metal shell 2, which consists of thin metal plate, is then bonded on the core part 3, 4 which consists of two materials in such a manner that the knobs 5 which are formed of the soft core part 3 extend through the openings 18 in the shell 2.

The second embodiment, shown in FIGS. 8 to 11, is a grip-shell for a pocket knife in which an edge recess 15 is provided, for instance for a corkscrew. The embodiment shown in FIGS. 12 and 13 corresponds to the opposite shell.

Figure 14:
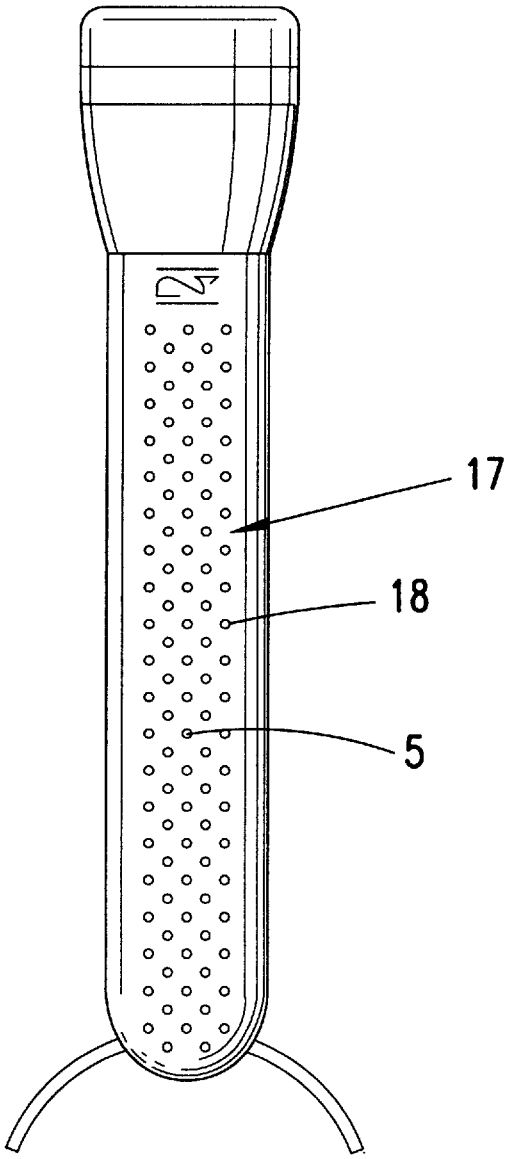
FIG. 14 shows another embodiment of the invention, in top view.

FIG. 14 shows a grip shell of another embodiment which serves to cover a flashlight housing. In this case also, two opposite grip shells can be provided; the connecting surface to the housing is here the surface of a cylindrical wall.

It is claimed:

1. A grip-shell arrangement for a utensil said arrangement having a housing, a housing wall of which is covered by at least one shell, each shell having a plurality of openings through which there extend plastic knobs of a plastic core which is located in a hollow space of the shell and constitutes a connecting member between the shell and the housing wall, wherein the plastic core has two regions of different hardness, the knobs being associated with a soft one of the regions, and a hard one the regions being located between the soft region and the housing wall to enable an attachment of the core to the housing.

2. A grip-shell arrangement according to claim 1, wherein the attachment to the housing is a snap fastening.

3. A grip-shell arrangement according to claim 1, wherein said hard region is a hard plastic part and said soft region is a soft plastic part, the hard plastic part has undercuts into which the soft plastic part is injected for a form-locked holding together of the two plastic parts.

4. A grip-shell arrangement according to claim 3, wherein the plastic core lies in form-filling manner in the shell and the soft plastic part is bonded to the inner wall of the shell.

5. A grip-shell arrangement according to claim 1, wherein the harder plastic region forms an inner cores, and the soft plastic region surrounds the inner core and contacts an edge region of the housing wall.

6. A grip-shell arrangement according to claim 5, wherein the housing wall has a plurality of snap-fastener studs and the inner core of harder material has corresponding openings.

7. A grip-shell arrangement according to claim 6, wherein the snap-fastener studs are formed by pins which extend transversely out of the housing wall and have radially extending circumferential projections on their end.

8. A grip-shell arrangement according to claim 7, wherein at least one of said pins is the extension of a pivot pin of a tool.

9. A grip-shell arrangement according to claim 6, wherein there are four of said snap-fastener studs.

10. A grip-shell arrangement according to claim 7, wherein that the circumferential projections are formed by profiled sleeves which are pressed onto the pins.

11. A grip-shell arrangement according to claim 1, wherein the harder plastic region forms an inner core, the inner core has a central undercut which is open on the housing-wall side and is filled by material of the soft region of the core.

12. A grip-shell arrangement according to claim 1, wherein the harder plastic region forms an inner core, the inner core has an interrupted slot which is open on the housing-wall side and is filled by material of the soft region of the core.

13. A pocket knife having a grip-shell arrangement, said arrangement having a housing, a housing wall of which is covered by at least one shell, each shell having a plurality of openings through which there extend plastic knobs of a plastic core which is located in a hollow space of the shell and constitutes a connecting member between the shell and the housing wall, wherein the plastic core has two regions of different hardness, the knobs being associated with a soft one of the regions, and a hard one of the regions being located between the soft region and the housing wall to enable an attachment of the core to the housing.

* * * * *